US007358428B2

(12) United States Patent
Bell et al.

(10) Patent No.: US 7,358,428 B2
(45) Date of Patent: Apr. 15, 2008

(54) DUAL SADDLE BRIDGE

(76) Inventors: David Bell, 136 Woodhead Road, Holmbridge, West Yorkshire (GB) HD9 2NL; Ronald Wright, P.O. Box 204, Carmel, CA (US) 93921

( * ) Notice: Subject to any disclaimer, the term of this patent is extended or adjusted under 35 U.S.C. 154(b) by 181 days.

(21) Appl. No.: 11/054,781

(22) Filed: Feb. 9, 2005

(65) Prior Publication Data

US 2005/0188814 A1 Sep. 1, 2005

Related U.S. Application Data

(60) Provisional application No. 60/544,615, filed on Feb. 12, 2004.

(51) Int. Cl.
*G10D 3/04* (2006.01)

(52) U.S. Cl. ..... 84/298; 84/297 R

(58) Field of Classification Search ..... 84/298, 84/297 R, 291, 307; D17/20
See application file for complete search history.

(56) References Cited

U.S. PATENT DOCUMENTS 3,407,696 A * 10/1968 Smith et al. ..... 84/297 R
3,633,452 A 1/1972 Beasley
3,656,395 A * 4/1972 Kaman ..... 84/267
4,084,475 A 4/1978 Horowitz
4,228,715 A * 10/1980 Nourney ..... 84/734
5,078,041 A * 1/1992 Schmued ..... 84/731
5,208,410 A * 5/1993 Foley ..... 84/307
5,753,838 A * 5/1998 Vanga, II ..... 84/297 R
6,169,236 B1 * 1/2001 Pilar, Jr. ..... 84/291
2003/0159562 A1 8/2003 Bailey

FOREIGN PATENT DOCUMENTS

WO WO 9416430 7/1994

* cited by examiner

*Primary Examiner*—Lincoln Donovan
*Assistant Examiner*—Jianchun Qin
(74) *Attorney, Agent, or Firm*—Fish & Associates, PC

(57) ABSTRACT

A stringed musical instrument has a body coupled to a single neck, multiple registers of strings, and a bridge that provides for at least one of acoustic and electronic separation of the multiple registers. The strings are preferrably arranged in paired courses, each of which has two members tuned to vibrate sympathetically with one another. In at least one of the members of each pair is a metallic string, and the other is a nylon or other non-metallic string. Preferred examples include a guitar, and more preferably an acoustic 12-string guitar. The bridge preferably has interleaved saddles for the various strings, each of which has its own associated pickup. The sounding board is reinforced with transverse brace struts. Optional equipment includes a balancing circuit that can be used to balance outputs of the vibration sensors.

17 Claims, 6 Drawing Sheets

DUAL SADDLE BRIDGE

This application claims the benefit of U.S. provisional application No. 60/544,615 filed on Feb. 12, 2004, incorporated herein by reference in its entirety.

FIELD OF THE INVENTION

The field of the invention is stringed musical instruments.

BACKGROUND OF THE INVENTION

Guitars and other stringed instruments are designed to accommodate a particular type of string. Classical guitars, for example, have a relatively large body with a thin top, scale length, neck width, bracing, and other characteristics suitable for gut or nylon strings. Steel string guitars generally have more leeway in overall design, but must have a stronger bracing system to adequately tension the strings. Of course, the sound varies enormously from instrument to instrument, with classical instruments generally providing soft, warm tones, and steel string instruments generally having brightness and clarity characteristic of metallic strings.

From time to time musicians have thought it desirable to provide completely different types of sounds from a single instrument. To that end it is known to employ two different sounding boards with a single set of strings. U.S. Pat. No. 3,633,452 to Beasley, for example, uses a single set of strings in conjunction with a special bridge that activates either guitar or banjo sounding boards. U.S. Pat. No. 3,633,452, as well as all other cited references, are incorporated herein by reference in their entirety.

It is also possible to use strings of different types in an instrument with only a single sounding board. One way to achieve that result is to provide two necks, each with its own set of strings. U.S. 20030159562 to Bailey (publ. Aug. 28, 2003), for example, discloses a guitar with two necks connected to a single body. The problem there, of course, is that the instrument becomes quite unwieldy.

Another possibility is to simply mismatch the strings. Thus, a musician may substitute a single nylon string among a set of gut strings. But the effect is problematic because in a typical instrument one would be merely replacing sounds rather than adding sounds. One could, of course, mismatch strings on an instrument with a large number of strings, but the mechanics are problematic. Thus, a 12 string solid body guitar could be strung with a lower register of nylon strings and a higher register of steel strings. But such a guitar would not adequately produce the sounds of the non-metallic strings. A conventional 12 string acoustic could be used, but the bracing required for 12 steel strings is too substantial to permit the top to be activated sufficiently by the lower tension nylon strings. In addition, a standard bridge for a 12 string guitar would be inadequate because it would not provide sufficient separation of the two registers of strings, either acoustically or electronically.

There are numerous bracing designs that provide superior strength using transverse braces and a central fan brace. Several of these have been patented or are patent pending, see e.g., WO 9416430 to Nieminen (publ. July 1994), U.S. Pat. No. 4,084,475 to Horowitz (April 1978), and U.S. Pat. No. 6,169,236 to Pilar et al. (January 2001). Unfortunately, those bracing systems are deemed to provide either insufficient strength, or to provide sufficient strength at the cost of detrimental effects on the sound produced.

Thus, there is a need for a musical instrument that has at least two registers of strings, and a bridge that separates the sounds of the different registers. There is a further need for a new bracing system in a hollow body guitar, which provides sufficient strength to handle full sets of both metallic and non-metallic strings, without unduly negative impact on the sound.

SUMMARY OF THE INVENTION

The present invention provides devices and methods in which a stringed and fretted musical instrument has a body coupled to a single neck, multiple registers of strings, and a bridge that provides for at least one of acoustic and electronic separation of the multiple registers.

In preferred embodiments the strings are arranged in paired courses, each of which has two members tuned to vibrate sympathetically with one another. In at least one of the members of each pair is a metallic string, and the other is a nylon or other non-metallic string. Further, the courses are advantageously arranged such that the strings of a given course are closer to one another than to adjacent strings of a different course.

The musical instrument is preferably a guitar, and more preferably a 12-string guitar. An especially preferred instrument is a 12-string acoustic guitar, although 12 string and other guitars having solid bodies are also contemplated.

The bridge preferably has interleaved saddles for the various strings, each of which has its own associated pickup. In especially preferred embodiments the bridge has interleaved front and rear saddles that rise equally above the base. The bridge can optionally include a different piezoelectric or other vibration sensor disposed beneath each of the saddles. Optional equipment includes a balancing circuit that can be used to balance outputs of the vibration sensors.

The body of the instrument has the bracing of a classical guitar, to allow for the full tonal response to the nylon strings, with the addition of transverse brace struts in critical positions to reinforce the top for the added tension of the steel strings, without compromising the sound.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
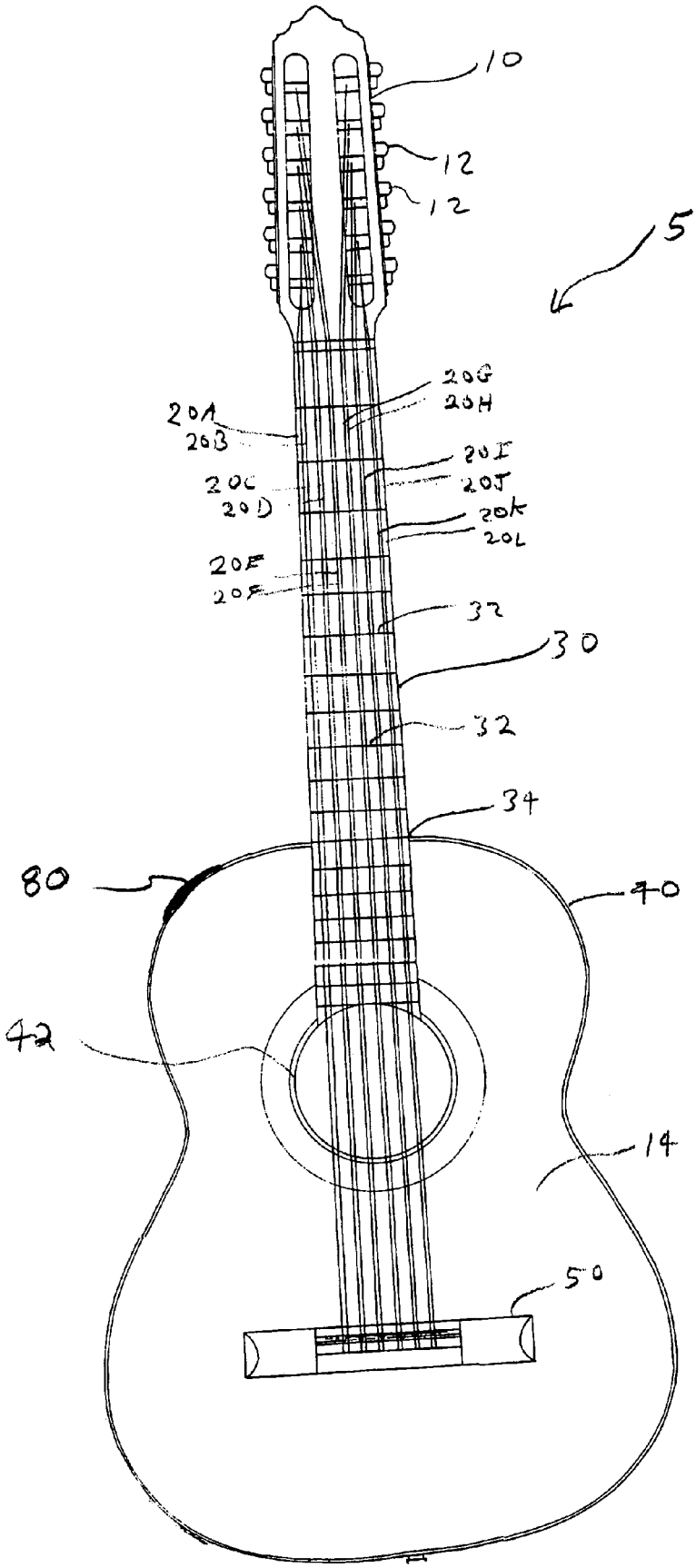
FIG. 1 is a plan view of a portion of a 12 string guitar.
Figure 3:
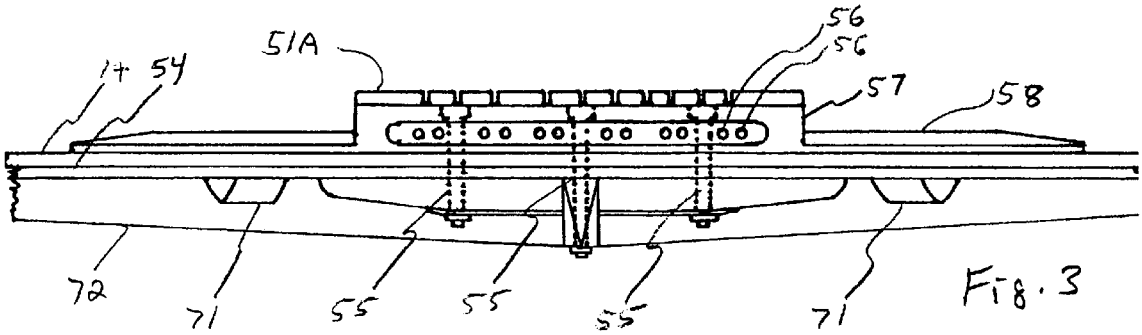
FIG. 3 is a cross-section of the bridge of FIG. 2.
Figure 2:
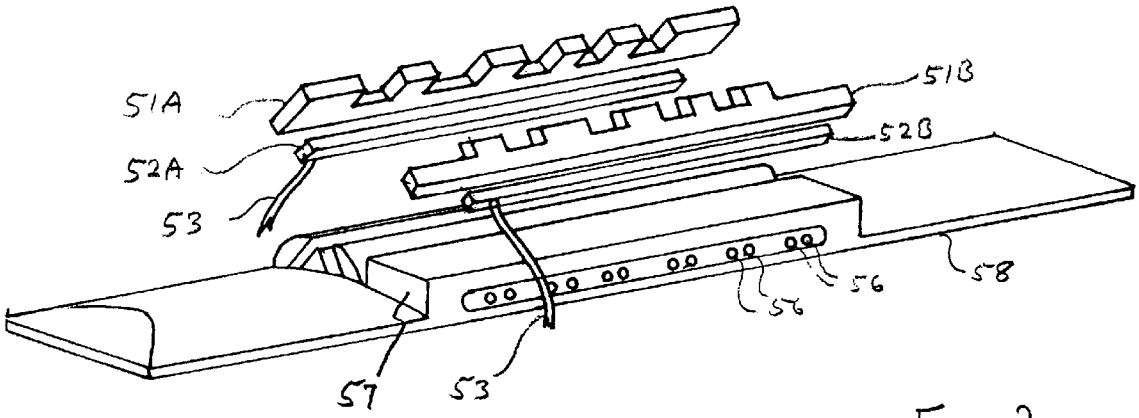
FIG. 2 is an exploded perspective view of a dual saddle bridge of the guitar of FIG. 1.
Figure 4:
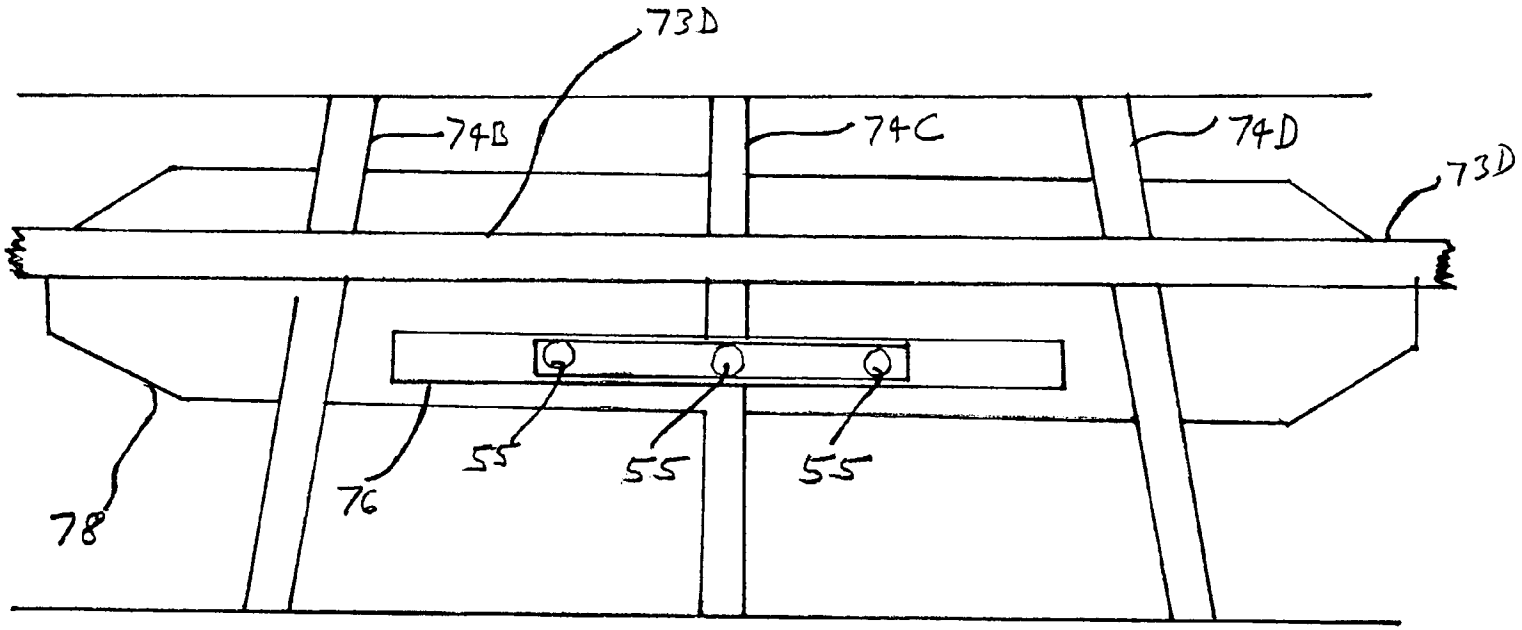
FIG. 4 is a bottom view of the bridge of FIG. 2.
Figure 5:
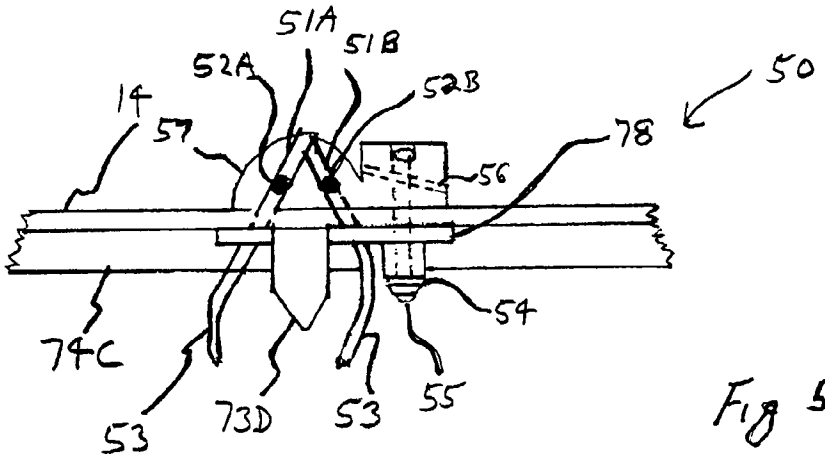
FIG. 5 is a end view of the bridge of FIG. 2.

In FIG. 1 a guitar 5 generally includes a headstock 10 with machine heads 12, top 14, sides 15, back 16, strings 20A-L (from left to right), a neck 30 with frets 32, a neck joint 34, a body 40, sound hole 42, and a bridge 50, and electronic controls 80.

Although guitar 10 is shown here as a classical acoustic guitar, it should also be interpreted as being indicative of a generic, fretted, stringed instrument, including for example a solid body steel guitar, or a lute. The headstock 10, machine heads 12, neck 30, and neck joint 34 are depicted in preferred embodiments, but are intended to be non-specific, and thereby include any components that could be reasonably substituted. Similarly, the body 40 is shown with a preferred size and shape, but is meant to include all reasonable sizes and shapes. Thus, the body 40 may or may not have sound hole 42, and may indeed have multiple sound holes (not shown). These various structural components are advantageously made from wood, but may comprise additional or substitute materials, including glues, plastics, and so forth.

Of particular interest are devices, methods, and instruments in which the strings 20A-L are of different types. Thus, one register of strings 20A, 20C, 20E, 20G, 20I, and 20K are generally metallic, (e.g., steel, silk and steel, bronze, phosphor bronze, metal core with nylon wrapping) and a second register of strings 20B, 20D, 20F, 20H, 20J, and 20L are generally non-metallic (gut, nylon monofilament, nylon core with nylon wrapping). To avoid ambiguity herein, the generally metallic strings are defined to include strings that contain non-de minimis amounts of both metal and non-metal, such as a nylon core with bronze wrapping. Also, more than two registers of strings are also contemplated, as well as different arrangements of the metallic and non-metallic strings.

As used herein, the term "register" requires at least three strings of a given type, each string of which is tuned to a different note. For example, a register could comprise at least three nylon or other non-metallic strings, or at least three steel or other metallic strings.

Dual Saddle Bridge

In FIGS. 2-5 bridge 50 generally includes steel string saddles 51A and nylon string saddles 51B, steel piezo pickup 52A and nylon piezo pickup 52B, pickup wires 53, metal plate 54, bolts 55, string holes 56, tie block 57, and base 58.

In this particular embodiment the front saddle 51A is used for the upper register of steel or other metallic strings, and the rear saddle 51B is used for the lower register of non-metallic strings. Each saddle 51A,B has an individual piezo pressure sensitive pickup 52A,B, respectively, installed underneath. These can be wired to any desired configuration, but ideally they would each have separate volume and tone controls, and be wired to a stereo pre-amped end jack. This allows for the balance of the two signals in a live performance setting. For recording purposes, a canon plug can advantageously be installed to provide direct access to the board signal. Other options include an on-board equalizer, and an interior microphone.

On the bridge body itself, the center block, consisting of the saddle block and the tie block, is preferably at least ⅛ of an inch wider than the wings. This is to reinforce the front saddle, which is taking the stress of the steel strings.

The saddles 51A, 51B are preferably cut in such a way so as not to touch each other at any point. This will allow for a clear separation of each pick-up, although there will be some bleed through, as they are both in the same piece of wood, i.e. the bridge body. Saddles 51A, 51B can be made from any suitable material, including for example ivory, bone, or hard plastic.

The saddle slots are cut at a 30 degree angle, leaving a center wedge of wood in the shape of a triangle, which serves the purpose of giving the saddles something to rest on, and keeps them separated.

The pick-ups 52A, 52B are advantageously set into the bridge in such a way that they are 1/64 of an inch higher than the base of the saddle slot. This allows for the pressure of the strings, when tuned up to pitch, to seat the saddle firmly on the pick-up. The pick-ups 52A, 52B should be designated for steel and nylon strings.

The string hole spacing in the tie block is critical, and needs to allow for the thickness of each course of strings, as well as being placed accurately enough to pass over the saddles at the proper points.

The bolt holes must be drilled in order to miss the string holes, and must pass through the transverse bridge cleat, as well as the center bolt passing through the center strut brace. The metal plate serves as a flat washer.

The holes for the pick-up wires must be drilled in such a way as to miss the lower transverse brace, as the brace must remain structurally sound.

The bolt holes on top of the tie block 57 are preferably covered up with the tie block decoration, and the edges of the tie block 57 are preferably inlaid with bone, to protect the wood from abrasion by the strings.

Bracing System and Construction

Figure 6:
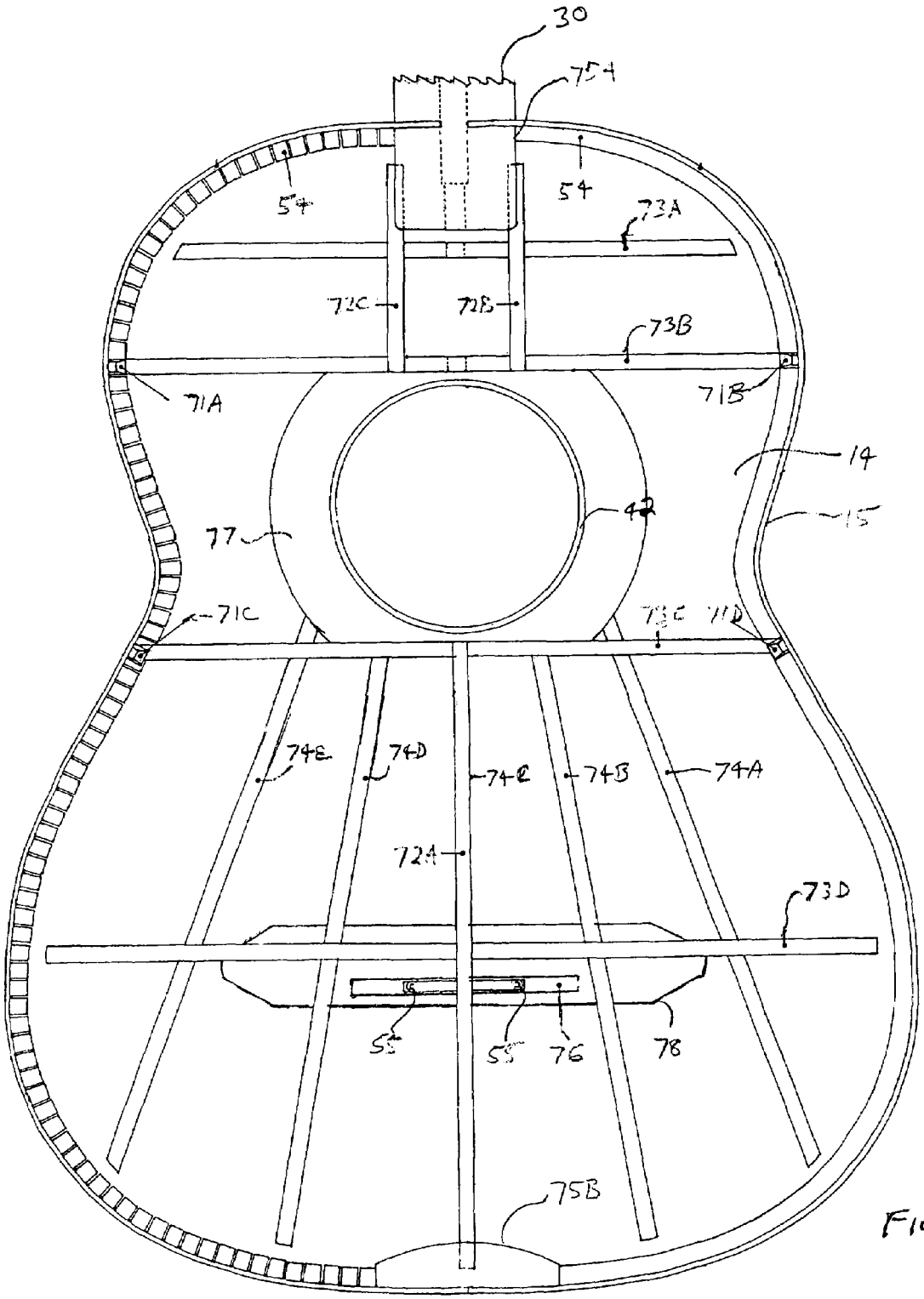
FIG. 6 is a schematic of a bottom of the sounding board of the guitar of FIG. 1, showing the bracing structure.
Figure 7:
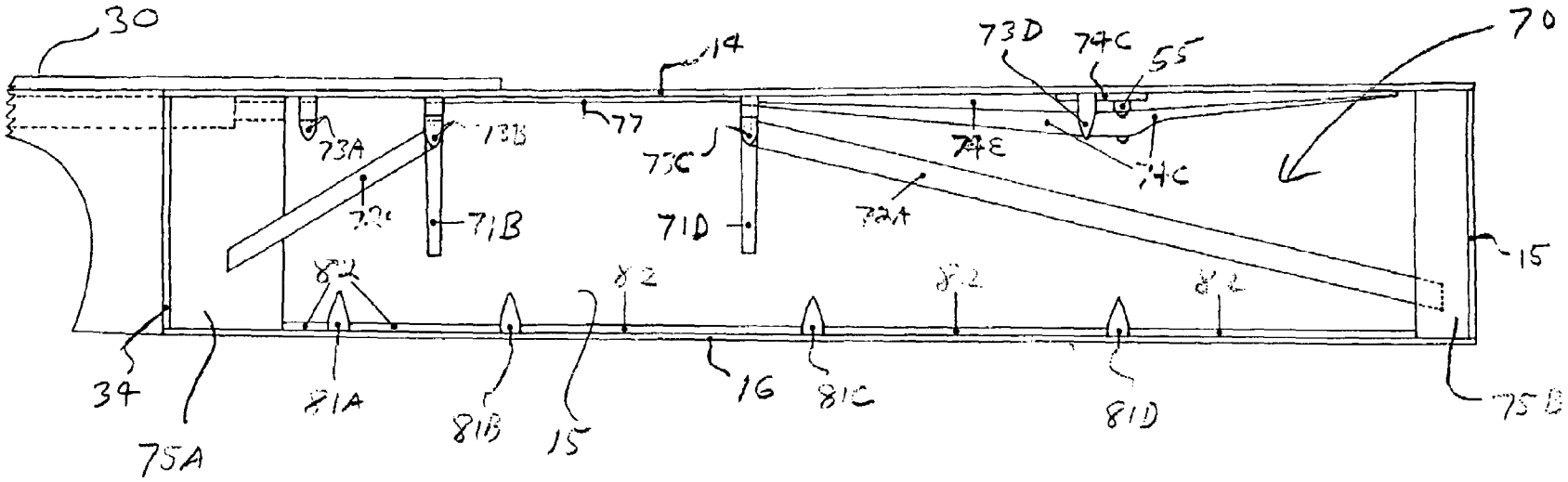
FIG. 7 is a schematic of a side view of the inside of guitar of FIG. 1, showing the bracing structure.
Figure 8:
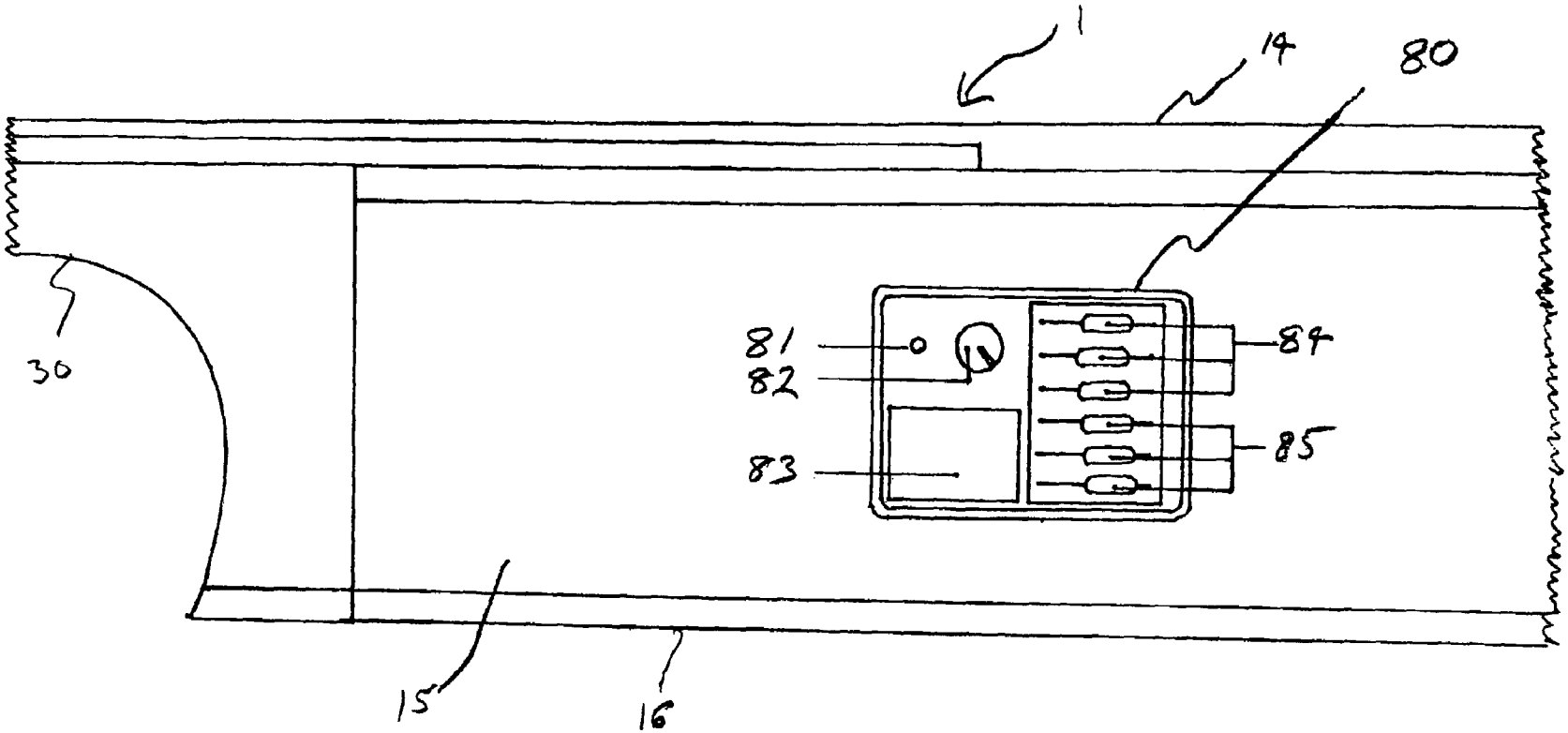
FIG. 8 is a plan view of a side view of the guitar of FIG. 1, showing electronics controls.

In FIGS. 6 and 7, a bracing system 70 generally includes side bracing 71A-D, transverse brace struts 72A-C, transverse brace 73A-D, fan braces 74A-E, head 75A and tail 75B blocks, transverse bridge cleat 76, sound hole graft 77, bridge graft 78, all arranged on the underside of the sound board 14. On the inside bottom of the back 16 of body 40, the bracing system 70 also includes back braces 81A-D, and back graft 82. The bridge 50 components are shown in relief.

The preferred designs of the body 40 and the bracing system 70 are a comprise between a nylon strung classical guitar and a steel strung guitar, with consideration given to the caveats that the guitar must be able to be played as a nylon strung classical guitar, with all the tonal characteristics involved, but also to be played as a steel strung guitar, with all of its tonal characteristics, as well as being able to be played with both types of strings at the same time.

The modifications to the exterior of the guitar 5 are minimal, consisting of a larger sound hole 42 than is generally found on a standard classical guitar, and the addition of the 12 string head stock 10.

Transverse brace struts 72A-C strengthen the weakest points of the soundboard, i.e., the sound hole 42, as well as increasing the tonal responses of the top 14. This is achieved by mortising the transverse brace strut 72A into the transverse brace 73C, and into the tail block 75B. The transverse brace struts 72B, 72C are mortised into the transverse brace designated 73B, and half mortised into the head block 75A. Transverse struts and braces can have any suitable dimensions. In the figures transverse brace strut 72A is 10¼" long, ¼" wide, and ⅜" high. Transverse brace struts 72A, 72B are each 3½" long, ¼" wide, and 5/16" high. Transverse braces are all ¼" thick. Transverse braces 73A, and 73D are each ⅝" high. Transverse braces 73B, 73C are each ¾" high.

The central fan brace 74C is designed to counter the pressure exerted by the dual saddle bridge 50 in the area between the bridge 50 and the sound hole 42, as well as provide support to the area immediately behind the bridge 50. This fan brace is half mortised into the transverse brace 73C and into the tail block 75B, providing strength and increasing the tonal response of the top. Fan braces 74A-E are all ¼" wide. Fan brace 74A is ⅛" high, brace 74B is 7/32" high, brace 74C is ⅝" high, braces 54D and 54E are each 5/16" high.

The transverse bridge cleat 76 is designed to give even distribution and relief of the pressure involved when the bridge is bolted down. The modification is advantageous because the addition of the steel strings 20A, 20C, 20E, 20G, 20I, and 20K exert anywhere from 90 to 120 extra pounds of pressure on the bridge 50, depending upon the brand and gauges of strings used, and because this pressure is exerted in an upward pulling motion.

Kerfing is preferably used to join the sides 15 to the back 16 and top 14, as opposed to lining, again, due to structural considerations.

A double acting truss rod is required to counteract the increased tension on the neck 30, and holes must be drilled in transverse braces 73A, 73B, to accommodate an adjusting wrench.

Back braces 81A-D can also be implemented in any suitable sizes and shapes. Currently preferred back braces have a width of $5/16^{th}$ inch and a height of $9/16^{th}$ inch. Back graft 82 preferably has a width of $5/8^{th}$ inch, and a height of $1/8^{th}$ inch. All elements of the drawing figures are to scale within each figure, but not between figures.

As far as bracing patterns for a classical guitar are concerned, there are a myriad to choose from, and they should all work, as long as the modifications described here are included. A preferred construction sequence for bracing the soundboard is as follows:

1. Install sound hole graft 77;
2. Install bridge graft 78;
3. Install transverse bridge cleat 76;
4. Install central fan brace 74C, mortised over 78 & 76;
5. Install fan braces 74B & 74D, mortised over 78;
6. Install fan braces 74A & 74E;
7. Install transverse braces 73A, 73B;
8. Install transverse brace 73C mortised over 74C;
9. Install transverse brace 73D mortised over 78, & 74A-E;
10. Install tail block 75B mortised over 74C;
11. Install neck 30;
12. Install transverse brace struts 72B, 72C mortised into 73B and half mortised into head block 75A; and
13. Install transverse brace strut 72A mortised into 73C and into tail block 75B.

From this point, proceed as is customary to finish the assembly of the sound box. When installing the bridge 50, care must be taken to assure that the holes for the bolts are placed exactly in the center of the transverse bridge cleat 76, as well as centered in the central fan brace 73C.

Electronic Controls

The electric controls 80 preferably comprises a triphonic blender system, generally having a power LED 81, master volume knob 82, battery box 83, graphic equalizer 84, and volume/blend controls 85.

Thus, specific embodiment, methods and applications have been disclosed of a stringed musical instrument having multiple registers, and a bridge that provides for at least one of acoustic and electronic separation of the multiple registers. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A stringed musical instrument comprising: a body coupled to a single neck; a first register of metallic strings interleaved with a second register of non-metallic string, the strings interleaved to form a plurality of pairs, each of the pairs having one member from the first register and one member from the second register, and wherein both first and second members of one of the pairs are tuned to vibrate to a given note; and a bridge coupled to a soundboard that provides for at least one of acoustic and electronic separation of sounds produced by the strings of the first and second registers and wherein all of the strings are permanently disposed in an operative plane and can be played simultaneously.

2. The instrument of claim 1, wherein at least one of the non-metallic strings comprises a-nylon.

3. The instrument of claim 1, wherein the instrument comprises a guitar.

4. The instrument of claim 3, wherein at least one of the non-metallic strings comprises a-nylon.

5. The instrument of claim 1, wherein the body is at least partially hollow.

6. The instrument of claim 1, wherein the instrument comprises a 12-string acoustic guitar.

7. The instrument of claim 1, wherein the bridge comprises at least two interleaved saddles.

8. The instrument of claim 7, wherein each of the interleaved saddles has its own associated pickup.

9. The instrument of claim 1, further comprising electronic balancing and volume controls.

10. The instrument of claim 1, wherein the body comprises head and tail blocks, and further comprising first and second transverse braces attached to the soundboard, a first transverse brace strut that extends between the head block and the first transverse brace, and a second transverse brace strut that extends between the tail block and the second transverse brace.

11. A bridge for a stringed musical instrument having a pair of strings, a first member of the pair belonging to a first register of strings and a second member of the pair belonging to a second register of strings, the members of the pair comprising different types of materials, and tuned to vibrate sympathetically with each other, the bridge having first and second saddles disposed to substantially separate out sounds produced by the first and second members of the pair.

12. The bridge of claim 11, wherein the saddles comprise front and rear saddles.

13. The bridge of claim 12, wherein the front and rear saddles are interleaved.

14. The bridge of claim 11, further comprising a base, and wherein the saddles effectively rise equally above the base.

15. The bridge of claim 11, wherein the saddles include a plurality of string supports that are spaced apart from one another by distances such that the bridge is suitable for use with a 12-string guitar.

16. The bridge of claim 11, wherein the saddles cooperate with different piezoelectric vibration sensors to produce the sounds.

17. The bridge of claim 16, further comprising a balancing circuit that can be used to balance outputs of the vibration sensors.

* * * * *